US007905258B2

(12) United States Patent
Bedeschi

(10) Patent No.: US 7,905,258 B2
(45) Date of Patent: Mar. 15, 2011

(54) VENTILATION ASSEMBLY FOR A MACHINE FOR THE PREPARATION OF RADIOPHARMACEUTICALS

(75) Inventor: Paolo Bedeschi, Castel Bolognese (IT)

(73) Assignee: Comecer S.p.A., Castel Bolognese (IT)

( * ) Notice: Subject to any disclaimer, the term of this patent is extended or adjusted under 35 U.S.C. 154(b) by 965 days.

(21) Appl. No.: 11/752,375

(22) Filed: May 23, 2007

(65) Prior Publication Data

US 2008/0011386 A1 Jan. 17, 2008

(30) Foreign Application Priority Data

May 23, 2006 (EP) ..... 06425344

(51) Int. Cl.
*B65B 31/00* (2006.01)

(52) U.S. Cl. ..... 141/51; 141/63; 141/65; 141/97; 250/436; 600/3

(58) Field of Classification Search ..... 141/18, 141/48, 51, 59, 63, 65, 97; 600/3–5; 250/436
See application file for complete search history.

(56) References Cited

U.S. PATENT DOCUMENTS

| | | | | |
|---|---|---|---|---|
| 4,041,994 | A | 8/1977 | Horowitz et al. | |
| 4,853,546 | A * | 8/1989 | Abe et al. | 250/432 PD |
| 5,039,863 | A * | 8/1991 | Matsuno et al. | 250/432 PD |
| 5,911,252 | A * | 6/1999 | Cassel | 141/27 |
| 6,691,747 | B1 * | 2/2004 | Marcus et al. | 141/48 |
| 6,870,175 | B2 * | 3/2005 | Dell et al. | 250/506.1 |
| 7,163,031 | B2 * | 1/2007 | Graves et al. | 141/27 |
| 7,712,491 | B2 * | 5/2010 | Tochon-Danguy et al. | 141/97 |
| 7,734,331 | B2 * | 6/2010 | Dhawale et al. | 600/431 |
| 7,750,328 | B2 * | 7/2010 | Tartaglia | 250/515.1 |
| 2005/0085682 | A1 * | 4/2005 | Sasaki et al. | 600/4 |
| 2005/0203329 | A1 * | 9/2005 | Muto et al. | 600/1 |
| 2008/0195249 | A1 * | 8/2008 | Rousso et al. | 700/231 |
| 2008/0242915 | A1 * | 10/2008 | Jackson et al. | 600/4 |
| 2009/0166370 | A1 * | 7/2009 | De Turk et al. | 221/8 |

FOREIGN PATENT DOCUMENTS

| | | | |
|---|---|---|---|
| GB | 957306 | * | 5/1964 |
| WO | 90/05549 | | 5/1990 |
| WO | 2004/026735 | | 4/2004 |

* cited by examiner

*Primary Examiner* — Timothy L Maust
*Assistant Examiner* — Nicolas A Arnett
(74) *Attorney, Agent, or Firm* — Ladas & Parry LLP

(57) ABSTRACT

A ventilation assembly for a machine for the preparation of radiopharmaceuticals. The ventilation assembly includes a suction apparatus and release apparatus for generating a circulation of air within a vacuum dispensing chamber, a product filling calibrator accommodated in the dispensing chamber and presenting a cavity accommodating a container to be filled with radiopharmaceutical, and a suction conduit adapted to connect a bottom portion of the accommodating cavity to the suction apparatus for creating a one-way flow in the accommodating cavity. Also, a machine that includes the ventilation assembly.

9 Claims, 2 Drawing Sheets

VENTILATION ASSEMBLY FOR A MACHINE FOR THE PREPARATION OF RADIOPHARMACEUTICALS

The present invention relates to a ventilation assembly for a machine for the preparation of radiopharmaceuticals.

BACKGROUND OF THE INVENTION

Generally, modern automated machines for the preparation of radiopharmaceuticals comprise a calibrator, within which is accommodated the flask in which the radiopharmaceuticals are deposited and a device for releasing the products within the flask.

Since it is often difficult to ensure a fluid-tight coupling between the flask and the intake device, especially when different types of vials may be used on the same machine, the need to avail of a solution so as to ensure an environment with an excellent aseptic degree is felt, in order to prevent undesired, polluting materials from being deposited within the flask itself.

SUMMARY OF THE INVENTION

The object of the present invention is a ventilation assembly for a machine for the preparation of radiopharmaceuticals, comprising suction means and release means for generating a circulation of air within a vacuum dispensing chamber, a product filling calibrator accommodated in said dispensing chamber and presenting a accommodating cavity for a container to be filled with radiopharmaceutical, and a suction conduit adapted to connect a bottom portion of said accommodating cavity to said suction means for creating a one-way flow in said accommodating cavity.

According to a preferred embodiment of the present invention, said suction means comprise a Venturi nozzle fed with compressed air.

According to a further preferred embodiment of the present invention, said connection means comprise a gap made in said product filling calibrator and extending about said housing cavity.

BRIEF DESCRIPTION OF THE DRAWINGS

The following example is provided by way of non-limiting illustration for better understanding of the invention with the help of the figures in the accompanying drawing, in which.

DETAILED DESCRIPTION OF THE INVENTION

Figure 1:
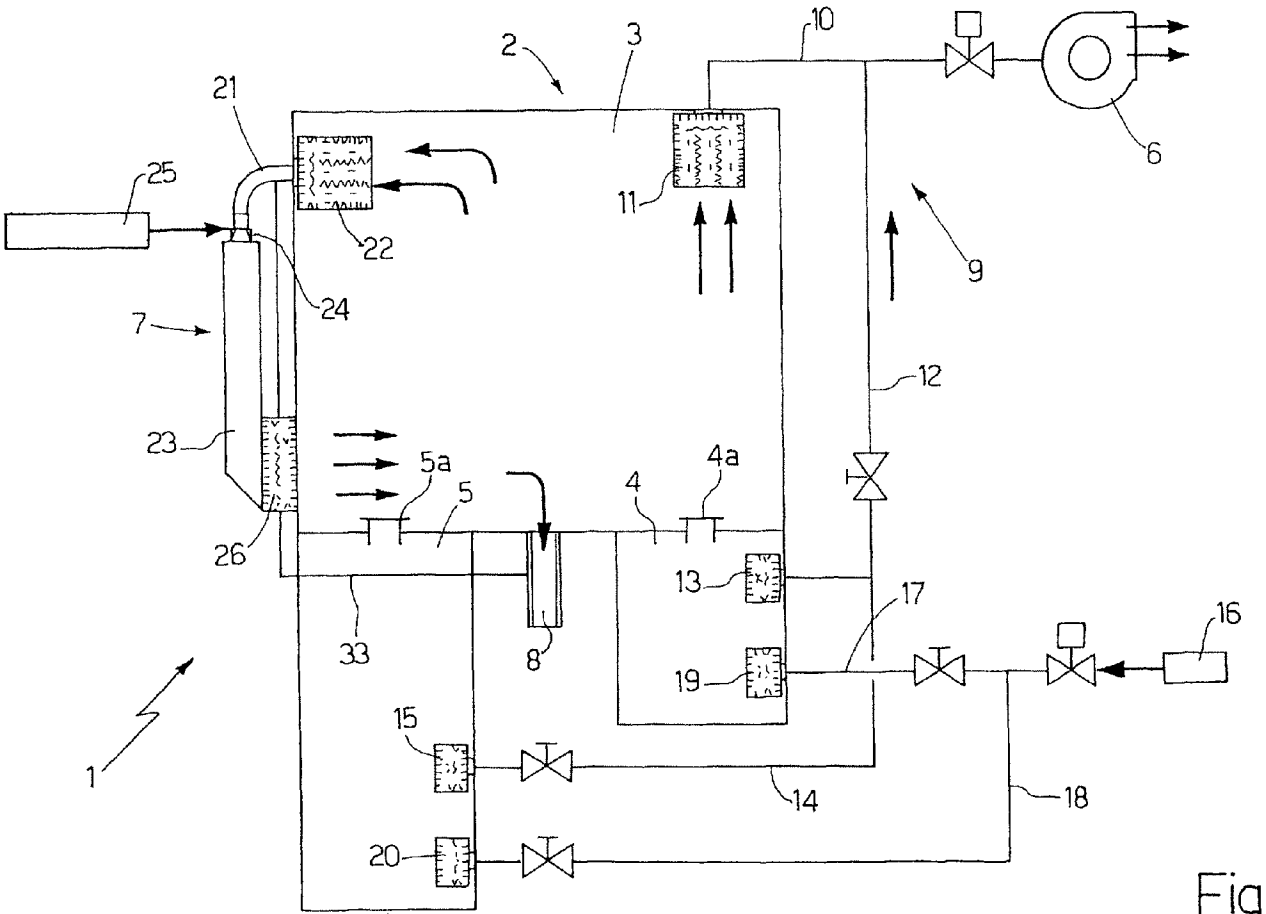
FIG. 1 is a schematic view of part of a machine for the preparation of radiopharmaceuticals comprising the ventilation assembly of the present invention.

In FIG. 1, it is indicated as a whole by 1 a ventilation assembly object of the present invention, which operates within part of a machine 2 for the preparation of radiopharmaceuticals comprising a dispensing chamber 3, a deposit chamber 4 of empty containers to be filled with the radiopharmaceutical and a collection chamber 5 of the containers appropriately filled with the radiopharmaceutical. Both deposit chamber 4 and collection chamber 5 are connected to dispensing chamber 3, from which they can be fluid-tightly insulated by means of two respective doors 4*a* and 5*a*.

Assembly 1 comprises a ventilator 6 which operates by suction within dispensing chamber 3, deposit chamber 4 and collection chamber 5, a Venturi device 7 which operates in release and suction within dispensing chamber 3 and a product filling calibrator 8 connected to Venturi device 7.

In particular, ventilator 6 is connected to a conduit network 9 in which a first branch 10 communicates with dispensing chamber 3 through an internal cartridge HEPA filter 11, a second branch 12 communicates with the deposit chamber 4 through a further internal cartridge HEPA filter 13 and a third branch 14 communicates with a collection chamber 5 through a further internal cartridge HEPA filter 15.

Assembly 1 further comprises an air intake device 16 (known and not shown in detail) into deposit chamber 4 and collection chamber 5 through two conduit branches 17 and 18 and two respective internal cartridge HEPA filters 19 and 20.

Venturi device 7 comprises a first conduit 21 communicating with dispensing chamber 3 through an internal cartridge HEPA filter 22, a second conduit 23 presenting a section whose diameter is larger than that of the first conduit 21, a Venturi nozzle 24 arranged between the first conduit 21 and the second conduit 23, and a compressed air intake device 25 (known and not described in detail) directly connected to Venturi nozzle 24. The second conduit 23 communicates with dispensing chamber 3 through a further internal cartridge HEPA filter 26.

Figure 2:
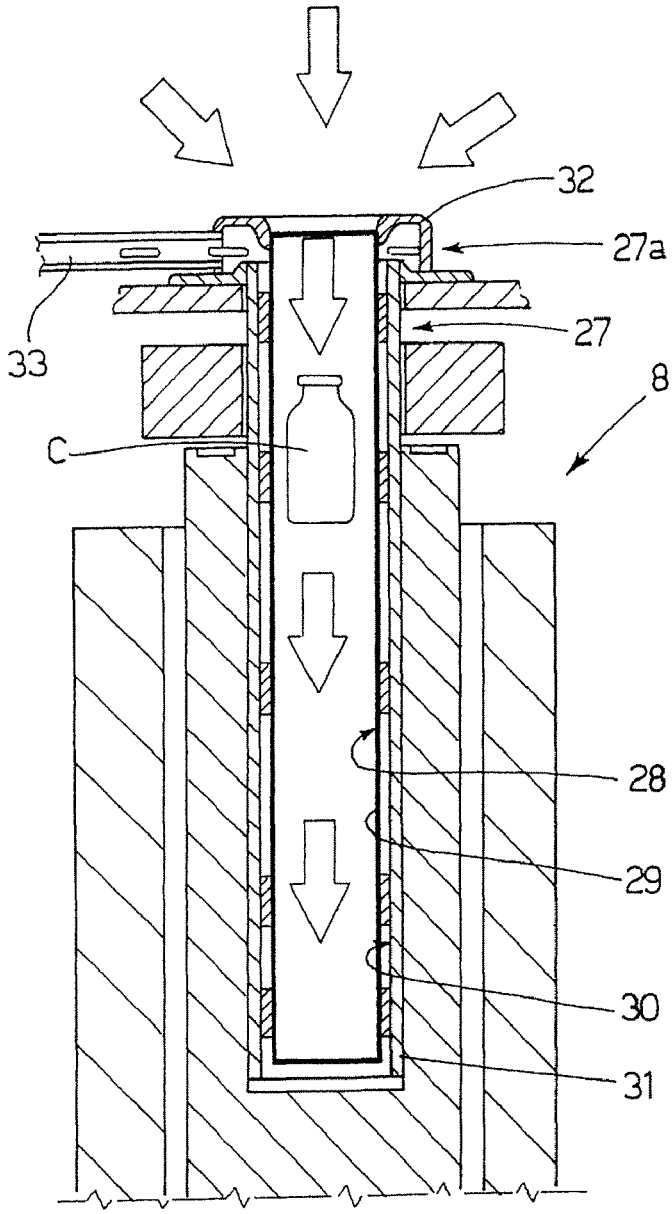
FIG. 2 is a section of the product filling calibrator of the ventilation assembly in FIG. 1.

As shown in FIG. 2, product filling calibrator 8 comprises a cylindrical double layer Plexiglas liner 27, which defines a cylindrical cavity 28 delimited by an inner layer 29, and in which container C (flask or syringe) is accommodated, and a gap 30 delimited by the inner layer 29 and by an outer layer 31 and connected to cylindrical cavity 28 at a bottom wall of the inner layer 29.

Calibrator 8 comprises a hollow ring 32 arranged about an upper end 27*a* of the double layer cylindrical liner 27. Hollow ring 32 communicates with gap 30 and is connected by means of a conduit 33 to first conduit 21.

In use, once ventilator 6 has generated the required vacuum in dispensing chamber 3, device 25 inputs compressed air at the Venturi nozzle, which generates a flow crossing the two HEPA filters 22 and 26. In particular, the flow of air enters dispensing chamber 3 through HEPA filter 26, arranged near calibrator 8, and is output from dispensing chamber 3 through HEPA filter 22.

Thanks to the connection between gap 30 and Venturi device 7, part of the flow is taken in through calibrator 8 so that container C during filling is constantly immersed in a downward current which ensures an ISO 5 classified environment (REF. ISO 14644-1).

Ventilator 6 creates a vacuum in deposit chamber 4 and in collection chamber 5 higher than that created in dispensing chamber 3. Such difference of pressure between deposit chamber 4 and collection chamber 5 and dispensing chamber 3, and the presence of fluid-tight doors 4*a* and 5*a*, makes it possible to access to chambers 4 and 5 respectively for depositing the empty containers or taking the filled containers without disturbing the environment in dispensing chamber 3 and, therefore, without interrupting the preparation of the radiopharmaceutical, which will continuously proceed.

Indeed, concerning deposit chamber 4, the operator opens an external door (not shown), deposits the containers (flasks and syringes) and closes the outer door again. At this point, the operator waits for the required vacuum to be recreated, and controls opening of door 4*a* and subsequent collection of the deposited containers by a robot.

Concerning collection chamber 5, the operator opens an outer door (not shown), loads a shielded casing and closes the outer flap. At this point, the operator waits for the required vacuum to be recreated, and controls opening of door 5*a* and subsequent collection of the shielded casing by a robot. The radiopharmaceutical container is automatically inserted in the shielded casing, which is returned to collection chamber 5. Door 5*a* is closed again and the operator may open the other door again and collect the shield casing containing the radiopharmaceutical container.

As apparent from the description above, the ventilation assembly according to the present invention ensures that the machine for the preparation of radiopharmaceuticals may perform the filling operation in an aseptic environment. In this way, the containers can be filled without necessarily ensuring fluid-tight coupling between the container and the filling device. Such advantage increases the versatility of the machine which may use differently sized containers without requiring demanding changes.

Another important advantages that the ventilation assembly offers is that the filling operation may be continuously performed without depositing and collecting operations disturbing the environment in the dispensing chamber.

The invention claimed is:

1. A ventilation assembly (1) for a machine (2) for the preparation of radiopharmaceuticals, comprising a vacuum dispensing chamber (3), suction means (21, 24) and release means (23) for generating a circulation of air within said vacuum dispensing chamber (3), a product filling calibrator (8) accommodated in said dispensing chamber (3) and presenting an accommodating cavity (28) for a container (C) to be filled with radiopharmaceutical, and a suction conduit (30, 33) connecting a bottom portion of said accommodating cavity (28) to said suction means (21, 24) for creating a one-way flow in said accommodating cavity (28).

2. A ventilation assembly according to claim 1, characterised in that said suction means comprise a Venturi nozzle (24) fed with compressed air.

3. A ventilation assembly according to claim 2, characterised in that it comprises a Venturi device (7) comprising a first conduit (21) communicating with said dispensing chamber (3), a second conduit (23) presenting a section of wider diameter with respect to that of said first conduit (21); a Venturi nozzle (24) arranged between the first conduit (21) and the second conduit (23), and a compressed air introduction device (25) being directly connected to the Venturi nozzle (24); said second conduit (23) being connected to said dispensing chamber (3).

4. A ventilation assembly according to claim 3, characterised in that said connection means comprise a gap (30) made in said product filling calibrator (8) and extending around said filling cavity (28).

5. A ventilation assembly according to claim 4, characterised in that the product filling calibrator (8) comprises a cylindrical double layer plexiglas liner (27), comprising an internal layer (29) defining said housing cavity (28), and an external layer (31) which with said internal layer (29) jointly defines said gap (30).

6. A ventilation assembly according to claim 5, characterised in that said calibrator (8) comprises a hollow ring (32) arranged around an upper end (27*a*) of said cylindrical double layer liner (27); said hollow ring (32) communicating with said gap (30) and being connected by means of a conduit (33) to said first conduit (21).

7. A machine for the preparation of radiopharmaceuticals, characterised in that it comprises a ventilation assembly according to claim 1.

8. A machine according to claim 7, characterised in that it comprises a deposit chamber (4) of empty containers to be filled with radiopharmaceutical, a collection chamber (5) of containers containing the radiopharmaceutical, and reversible closing means (4*a*, 5*a*) adapted to fluid-tightly isolate said deposit (4) and collection (5) chambers from said dispensing chamber (3), and in that said ventilation assembly comprises pressure regulating means adapted to generate in said deposit (4) and collection (5) chambers a vacuum higher than that of said dispensing chamber (3).

9. A machine according to claim 8, characterised in that said pressure regulating means comprise a ventilator (6), which is connected by suction to said dispensing chamber (3), said deposit chamber (4) and said collection chamber (5), a first air intake device (25) within said dispensing chamber (3) and a second air intake device (16) in said deposit (4) and collection (5) chambers.

* * * * *